US009050827B2

(12) United States Patent
Okuno

(10) Patent No.: US 9,050,827 B2
(45) Date of Patent: Jun. 9, 2015

(54) PRINTING METHOD AND PRODUCT WHICH PRINTS ON A BENT PART

(71) Applicants: Kawasaki Special Printing Co., Ltd., Sapporo-shi, Hokkaido (JP); Shinji Okuno, Katsushika-ku, Tokyo (JP); Hiroshi Matsumoto, Katsushika-ku, Tokyo (JP)

(72) Inventor: Shinji Okuno, Tokyo (JP)

(73) Assignees: Kawasaki Special Printing Co., Ltd., Sapporo (JP); Shinji Okuno, Tokyo (JP); Hiroshi Matsumoto, Tokyo (JP)

( * ) Notice: Subject to any disclaimer, the term of this patent is extended or adjusted under 35 U.S.C. 154(b) by 0 days.

(21) Appl. No.: 14/358,408

(22) PCT Filed: Oct. 15, 2012

(86) PCT No.: PCT/JP2012/076609
§ 371 (c)(1),
(2) Date: May 15, 2014

(87) PCT Pub. No.: WO2013/077112
PCT Pub. Date: May 30, 2013

(65) Prior Publication Data

US 2014/0315000 A1 Oct. 23, 2014

(30) Foreign Application Priority Data

Nov. 24, 2011 (JP) ..... 2011-255880

(51) Int. Cl.
*B41J 3/407* (2006.01)
*B05D 7/00* (2006.01)

(Continued)

(52) U.S. Cl.
CPC ..... *B41J 3/407* (2013.01); *Y10T 428/24736* (2015.01); *B05D 7/00* (2013.01); *B05D 1/26* (2013.01); *B41M 5/0088* (2013.01); *B41J 3/4073* (2013.01); *H04R 5/0335* (2013.01)

(58) Field of Classification Search
CPC ..... B41F 15/30; B41J 3/4073; B41M 5/0088; B41M 5/0094
USPC ..... 101/491, 485, 35, 41; 347/16, 101, 104, 347/105, 106; 400/55
See application file for complete search history.

(56) References Cited

U.S. PATENT DOCUMENTS

| | | | | |
|---|---|---|---|---|
| 4,590,854 | A * | 5/1986 | Anderson | 101/35 |
| 7,980,177 | B2 * | 7/2011 | Styles et al. | 101/483 |
| 2004/0204207 | A1 * | 10/2004 | Parker | 455/575.2 |

FOREIGN PATENT DOCUMENTS

| | | | |
|---|---|---|---|
| JP | 5-318715 | A | 12/1993 |
| JP | 2002-225256 | A | 8/2002 |

(Continued)

OTHER PUBLICATIONS

JP 2004042464 A Machine Translation.*

(Continued)

*Primary Examiner* — Blake A Tankersley
(74) *Attorney, Agent, or Firm* — Sughrue Mion, PLLC

(57) ABSTRACT

With respect to a product having a resin bent part, an image is color-printed on the bent part. When the image is printed with respect to a head band 10 as a resin bent part of a headphone, load is applied to the head band 10 so as to stretch the head band. The stretched head band 10, in the stretched state, is fixed with a jig 40. Then color printing using UV ink is performed with an ink jet printer or the like with respect to the head band 10 fixed with the jig 40.

9 Claims, 11 Drawing Sheets

(51) Int. Cl.

| | |
|---|---|
| ***B05D 1/26*** | (2006.01) |
| ***B41M 5/00*** | (2006.01) |
| ***H04R 5/033*** | (2006.01) |

(56) References Cited

FOREIGN PATENT DOCUMENTS

| | | | | | |
|---|---|---|---|---|---|
| JP | 2004-42464 | A | | 2/2004 | |
| JP | 2004042464 | A | * | 2/2004 | ..... B41J 2/01 |
| JP | 2004-82442 | A | | 3/2004 | |
| JP | 2011-156819 | A | | 8/2011 | |

OTHER PUBLICATIONS

International Search Report for PCT/JP2012/076609 dated Nov. 6, 2012.

* cited by examiner

PRINTING METHOD AND PRODUCT WHICH PRINTS ON A BENT PART

CROSS REFERENCE TO RELATED APPLICATIONS

This application is a National Stage of International Application No. PCT/JP2012/076609 filed Oct. 15, 2012, claiming priority based on Japanese Patent Application No. 2011-255880 filed Nov. 24, 2011, the contents of all of which are incorporated herein by reference in their entirety.

TECHNICAL FIELD

The present invention relates to a printing method for printing an image with respect to a product and a product on which the image is printed by this printing method.

BACKGROUND ART

In recent years, in accordance with progress of printer functions, it is possible to perform printing with respect to various products. Especially, by virtue of progress of ink jet printers, it is possible to perform printing with respect to products in various shapes. Since an ink jet printer discharges and attaches ink to a printing object, it is possible to perform printing even when the printing object has some irregularity on its surface.

However, even when this ink jet printer is used, it is not possible to print an image with respect to a bent part having a large amount of curvature such as a head band of a headphone. When printing is to be performed on such head band, the end of the head band is away from an ink discharge part and a printing object surface is slanted with respect to an ink discharge direction. Accordingly, it is impossible to appropriately and finely print an image on it.

As a method of printing an image with respect to such bent part having a large amount of curvature, a method of attaching an image using a seal, a method of pad printing (e.g., see Patent Literature 1), heat transfer printing and the like may be used.

However, the method of attaching an image using a seal is not a method of printing an image, and has a crucial failing. Since the seal is peeled off due to deterioration over time, the part is unclean.

Further, in the method of pad printing, it is not possible to print an image on a bent part by color printing. The pad printing is to transfer a print pattern on a pad transfer surface made of rubber material and press the transfer surface against a printing object so as to transfer the print pattern on the printing object surface. Therefore, according to this pad printing, it is possible to print an image on a printing object surface in a curved surface shape. However, in this pad printing, only monochrome printing using one sort of ink is possible, and it is not possible to realize color printing by the pad printing.

Further, in the printing by thermal transfer, when a printing object is made of a material which is not tolerant to high temperature such as resin, the method cannot be used since the printing object is melt by heat.

CITATION LIST

Patent Literature

PTL 1: Japanese Patent Application Laid-Open No. 2011-156819

SUMMARY OF INVENTION

Technical Problem

Due to the above-described reasons, even when any of the conventional printing methods is used, it is not possible to print an image by color printing with respect to a resin bent part. However, in recent years, there are needs for printing an image by color printing on various parts of a product, and a printing method for printing an image by color printing on a bent part, with respect to a product having a resin bent part, is required.

The object of the present invention is to provide a printing method capable of printing an image, with respect to a product having a resin bent part, on the bent part, by color printing, and to provide a product on which the image is printed by the printing method.

Solution to Problem

[Printing Method]

A printing method according to the present invention is a printing method with respect to a product having a resin bent part, including:

a step of stretching the bent part by loading the bent part;

a step of fixing the stretched bent part, in a stretched state, with a jig; and a step of performing color printing with respect to the bent part fixed with the jig.

Further, in the present invention, it may be arranged such that at the step of performing color printing with respect to the bent part fixed with the jig, color printing using UV ink is performed with respect to the bent part fixed with the jig.

Further, in the present invention, it may be arranged such that at the step of performing color printing using UV ink with respect to the bent part fixed with the jig, color printing using UV ink by ink jet printing is performed with respect to the bent part fixed with the jig.

Further, in the present invention, it may be arranged such that the product is a headphone, and the bent part is a head band.

[Product]

Further, a product according to the present invention is a product having a resin bent part, wherein an image is printed on the bent part by a printing method including:

a step of stretching the bent part by loading the bent part;

a step of fixing the stretched bent part, in a stretched state, with a jig; and a step of performing color printing with respect to the bent part fixed with the jig.

Advantageous Effects of Invention

According to the present invention, it is possible to provide a printing method capable of printing an image, with respect to a product having a resin bent part, on the bent part, by color printing, and to provide a product on which an image is printed by the printing method.

DESCRIPTION OF EMBODIMENTS

Next, embodiments of the present invention will be described in detail with reference to the drawings.

Figure 1:
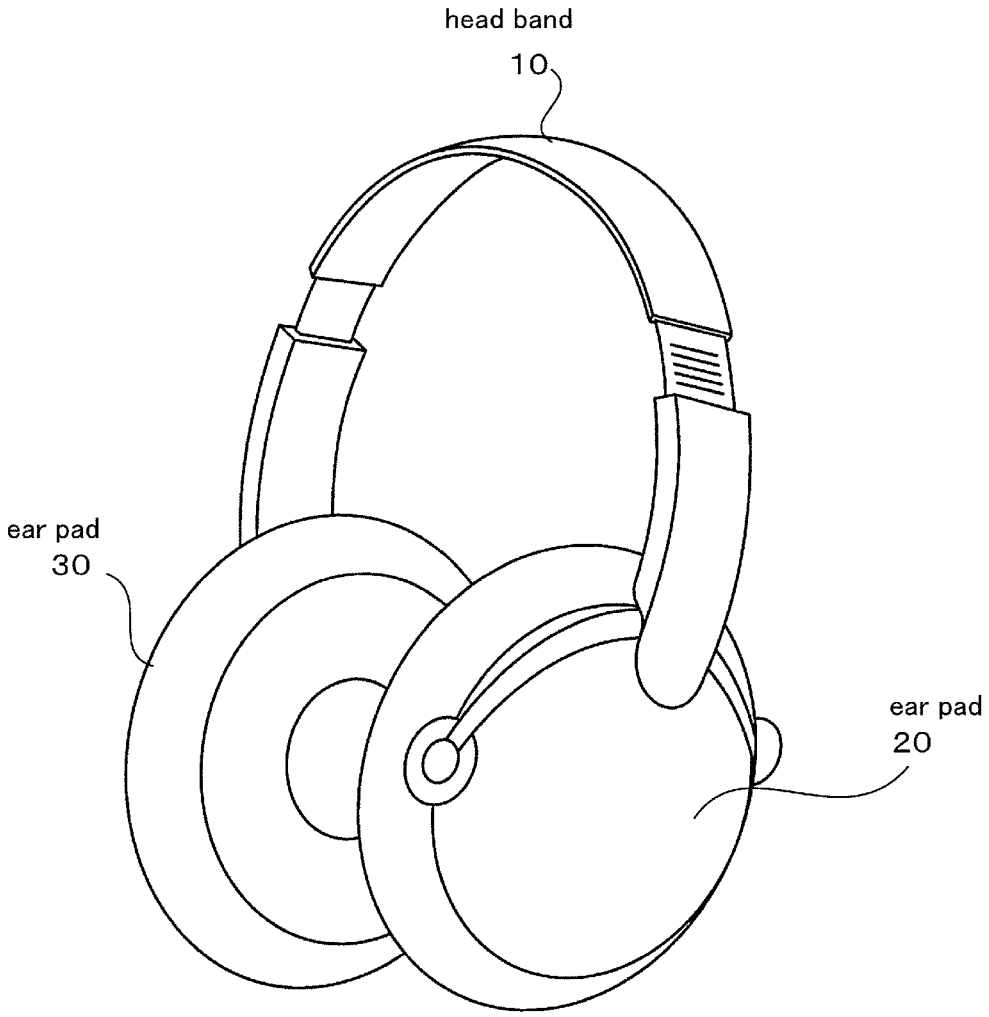
FIG. 1 is a diagram showing an overview of a headphone as a product on which an image is to be printed by color printing, by a printing method according to an embodiment of the present invention.

FIG. 1 is a diagram showing an overview of a headphone as a product on which an image is printed by color printing by a printing method according to an embodiment of the present invention.

Figure 2:
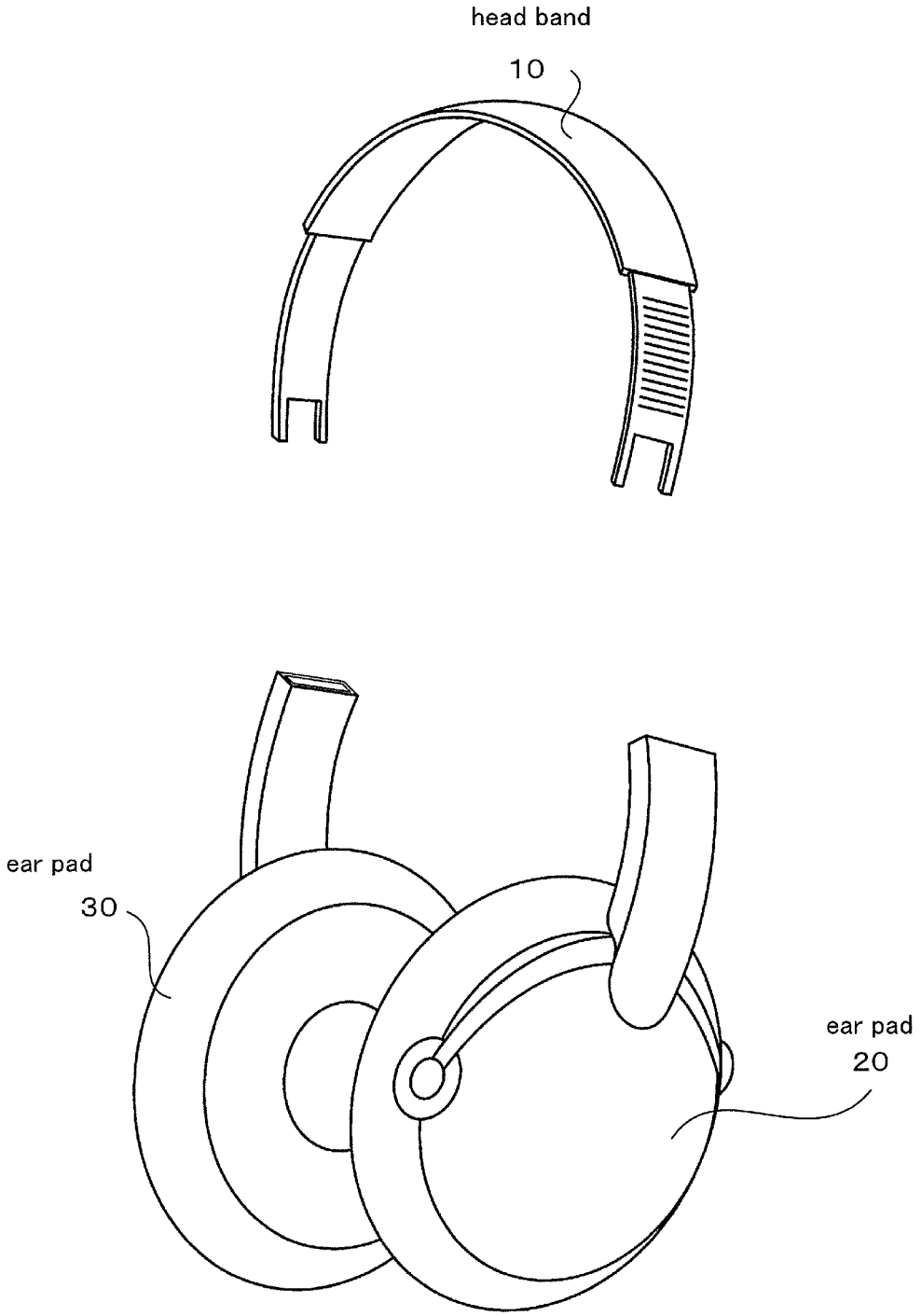
FIG. 2 is a diagram showing an exploded view of the headphone shown in FIG. 1.

As shown in FIG. 1, this headphone has a head band 10 and left and right ear pads 20 and 30. As shown in FIG. 2, in the headphone, the head band 10 and the left and right ear pads 20 and 30 are disassemblable.

In the present embodiment, a printing method when an image is to be printed by color printing on a bent surface of the head band 10 will be described. When the image is to be printed on the head band 10 of this headphone by the printing method according to the present embodiment, first, as shown in FIG. 2, the head band 10 and the left and right ear pads 20 and 30 are disassembled.

Figure 3:
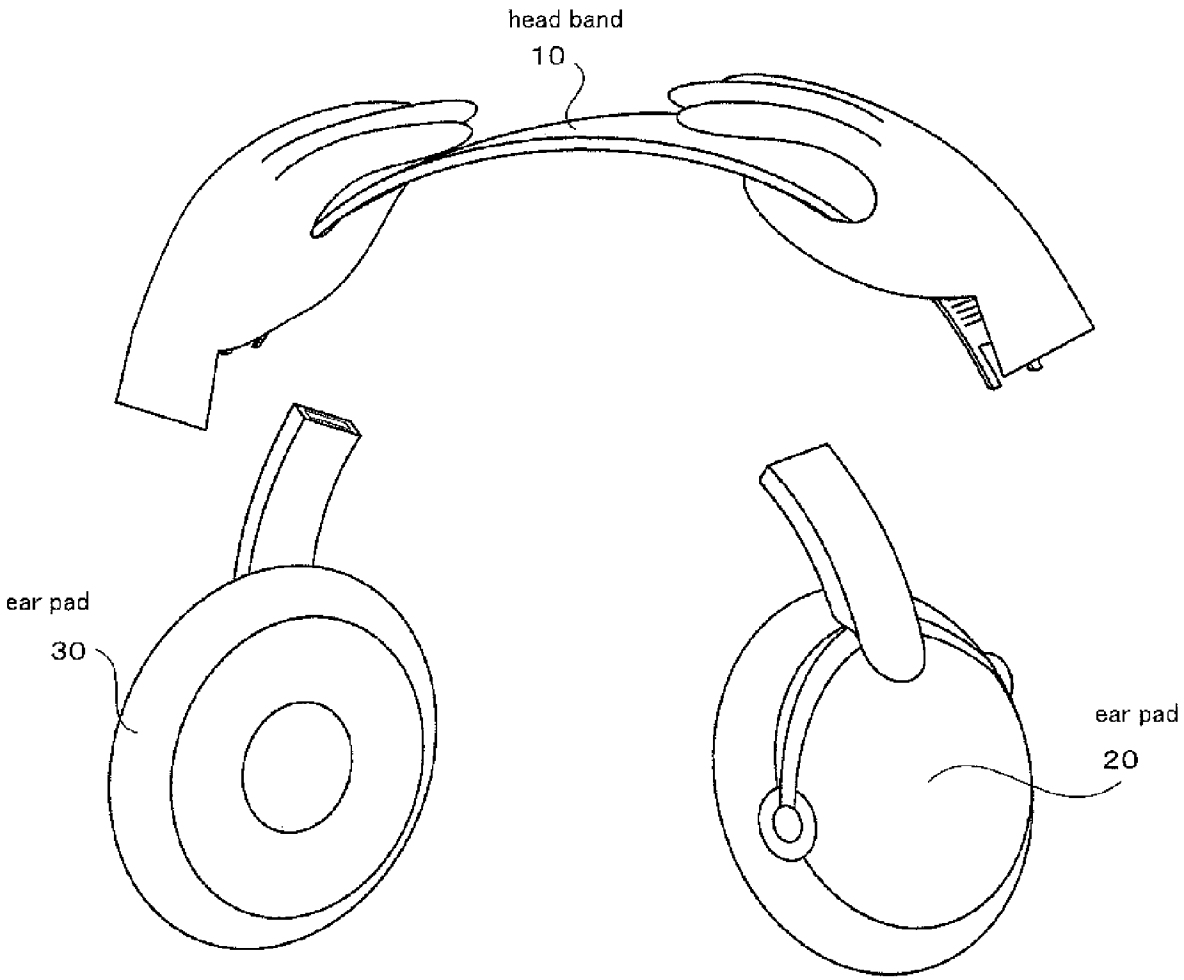
FIG. 3 is a diagram showing a loaded and stretched head band 10.

Next, as shown in FIG. 3, the bent head band 10 is stretched to be flat-shaped by disassembling the headphone, then removing the headband 10 from the headphone, and loading the head band 10.

Figure 4:
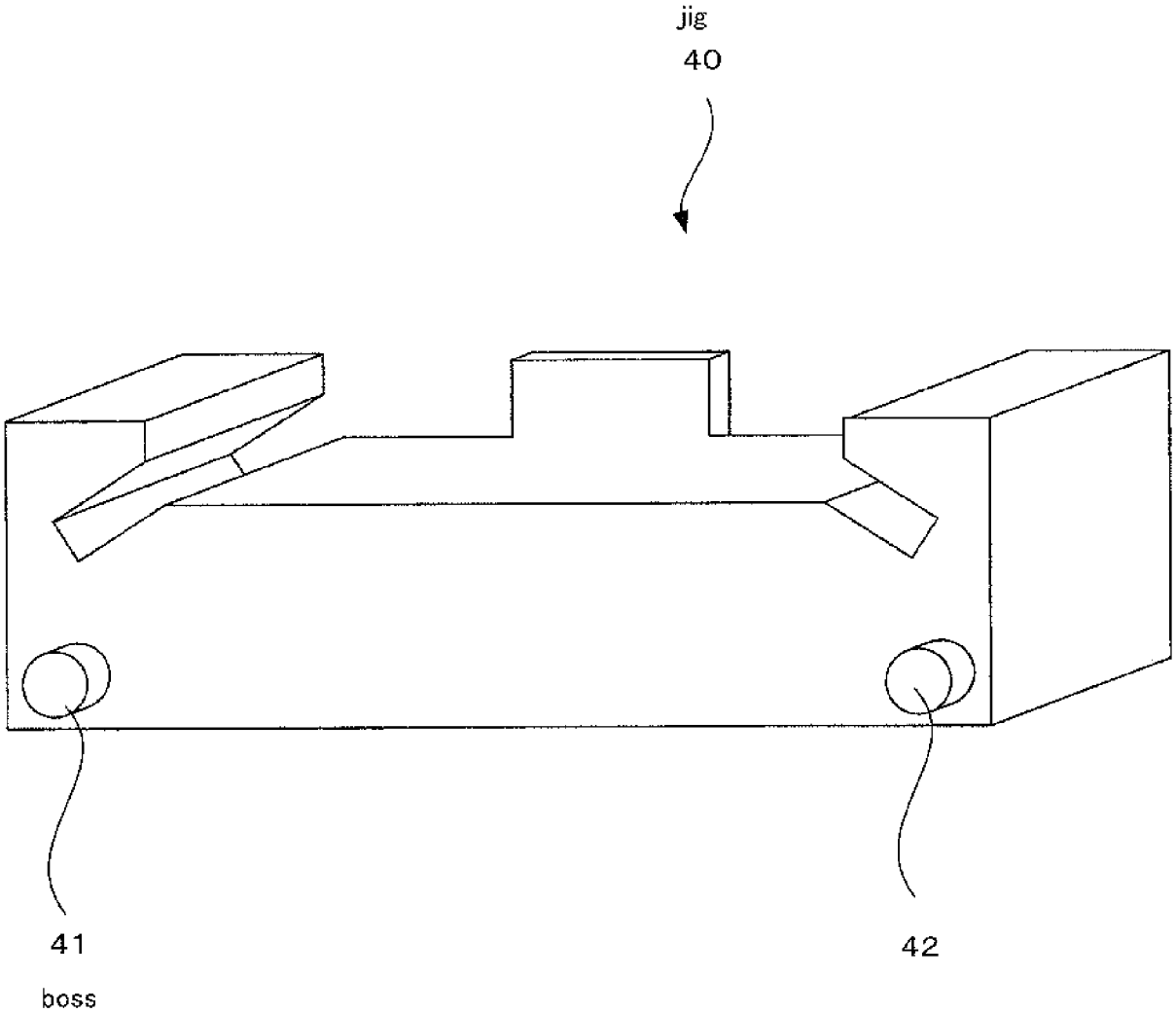
FIG. 4 is a perspective diagram for explaining the structure of a jig 40 used in the printing method according to the embodiment of the present invention.

Then, the stretched head band 10, in the stretched state, is fixed with a jig 40 as shown in FIG. 4.

As shown in FIG. 4, the jig 40 used in the printing method according to the present embodiment is formed in accordance with the shape of the head band 10 on which the image is to be printed. The jig 40 has a shape to, not only fix the head band 10, but also fix the head band 10 in the stretched state.

Figure 5:
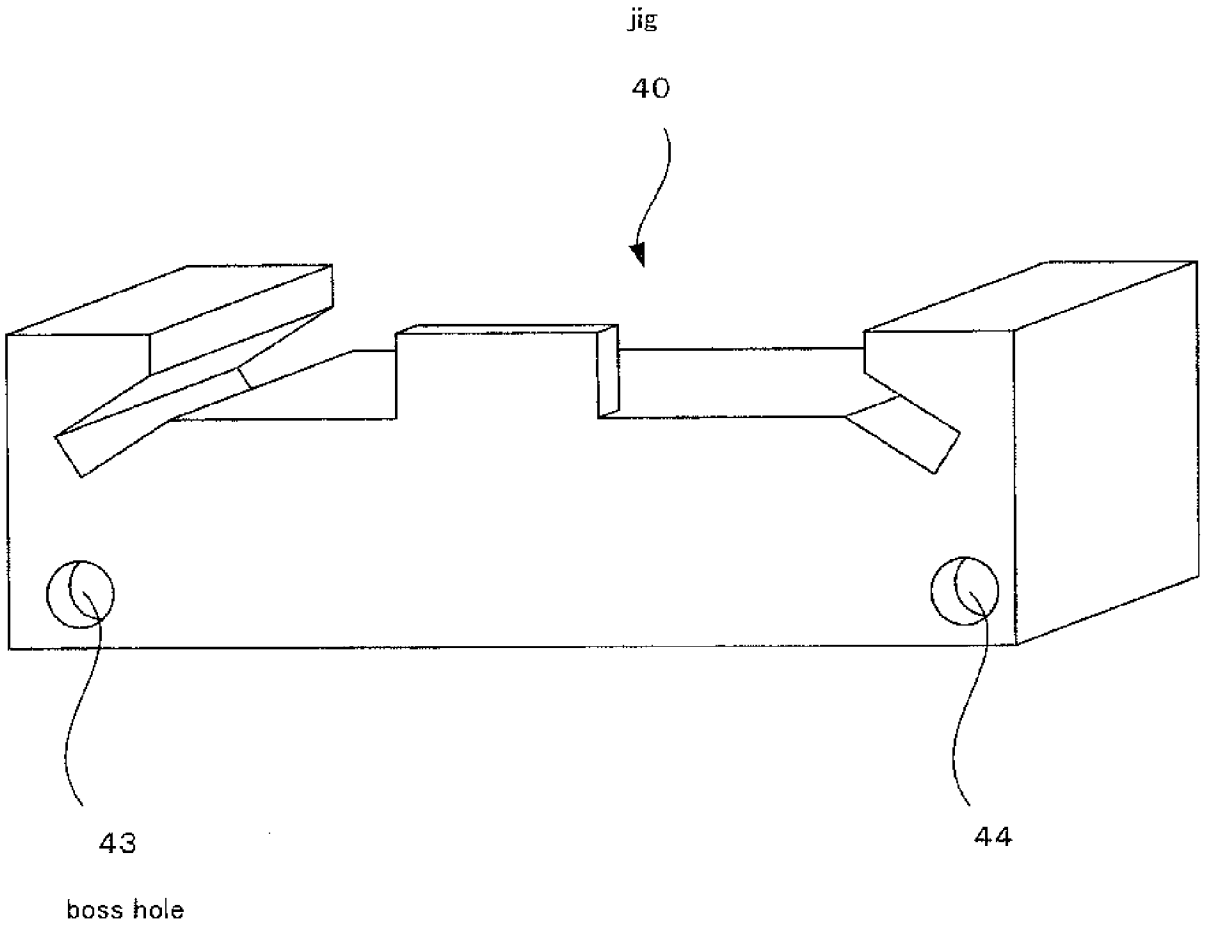
FIG. 5 is a perspective diagram for explaining the structure of an opposite side of the jig 40 used in the printing method according to the embodiment of the present invention.

Note that one side of the jig 40 is provided with bosses (projections) 41 and 42 in two positions. Further, as shown in FIG. 5, the other side is provided with boss holes 43 and 44 to be engaged with the bosses 41 and 42 of another jig 40.

Figure 6:
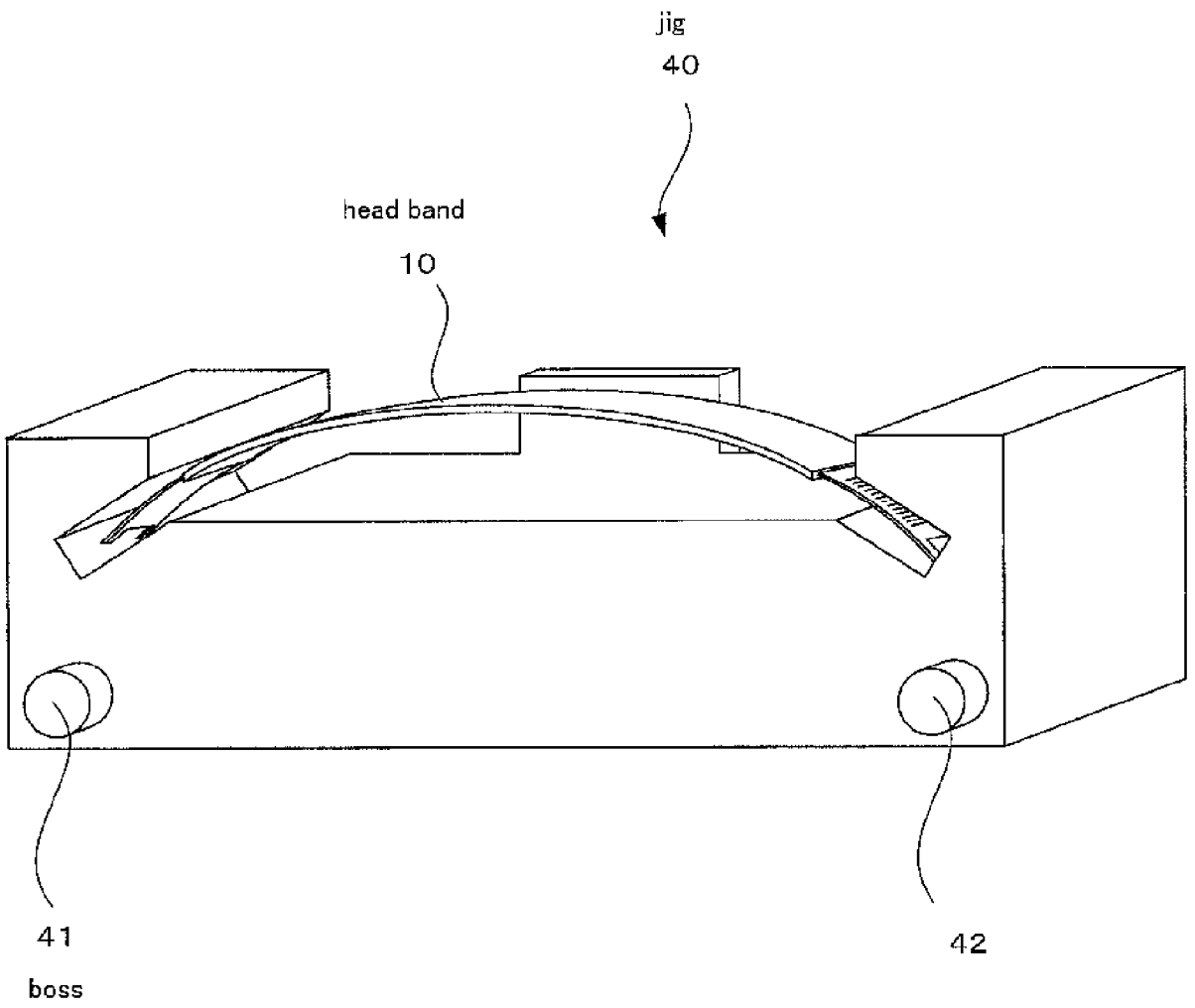
FIG. 6 is a diagram showing the head band 10 fixed to the jig 40 in a stretched state.

FIG. 6 shows the head band 10 fixed to the jig 40 in the stretched state. Referring to FIG. 6, the head band 10 fixed with the jig 40 is not completely flat but flat to such a degree that the image can be printed by ink jet printing.

In the printing method according to the present embodiment, printing is performed while plural jigs 40, to each of which the head band 10 in the stretched state is fixed, are connected. Note that since the jig 40 is provided with the bosses 41 and 42 and the boss holes 43 and 44, adjacent jigs are arrayed without being shifted.

The printing performed when, e.g. six jigs are connected, will be described. In the following description, the six jigs 40 are denoted as 40*a* to 40*f*.

Figure 7:
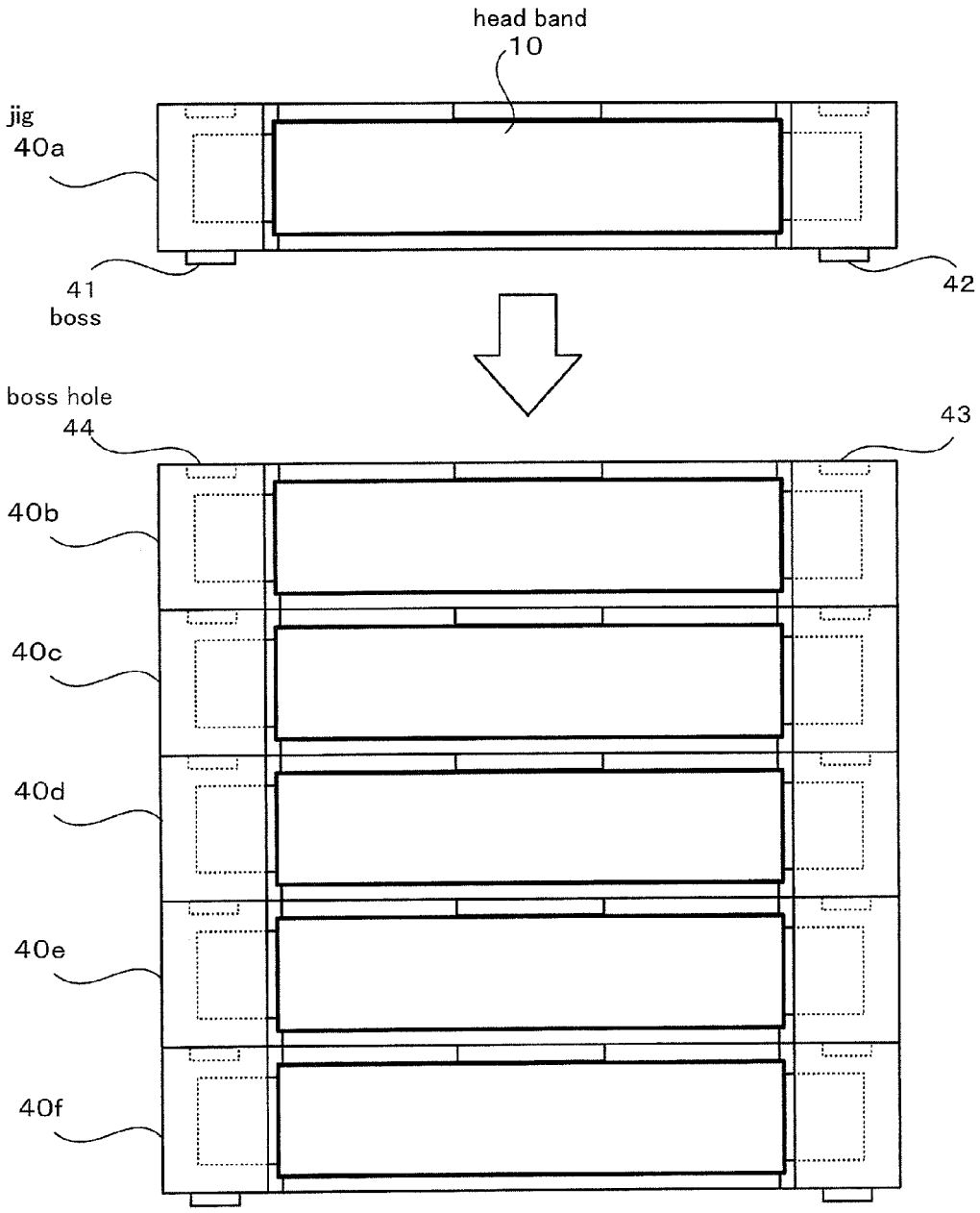
FIG. 7 is a diagram showing connection of six jigs 40*a* to 40*f*.

First, the connection of the six jigs 40*a* to 40*f* will be described with reference to FIG. 7. In FIG. 7, the bosses 41 and 42 of the jig 40*a* are engaged with the boss holes 44 and 43 of the adjacent jig 40*b*, and the jigs are connected without being shifted. In this manner, the six jigs 40*a* to 40*f* are connected without being shifted by being connected with its adjacent jig.

Figure 8:
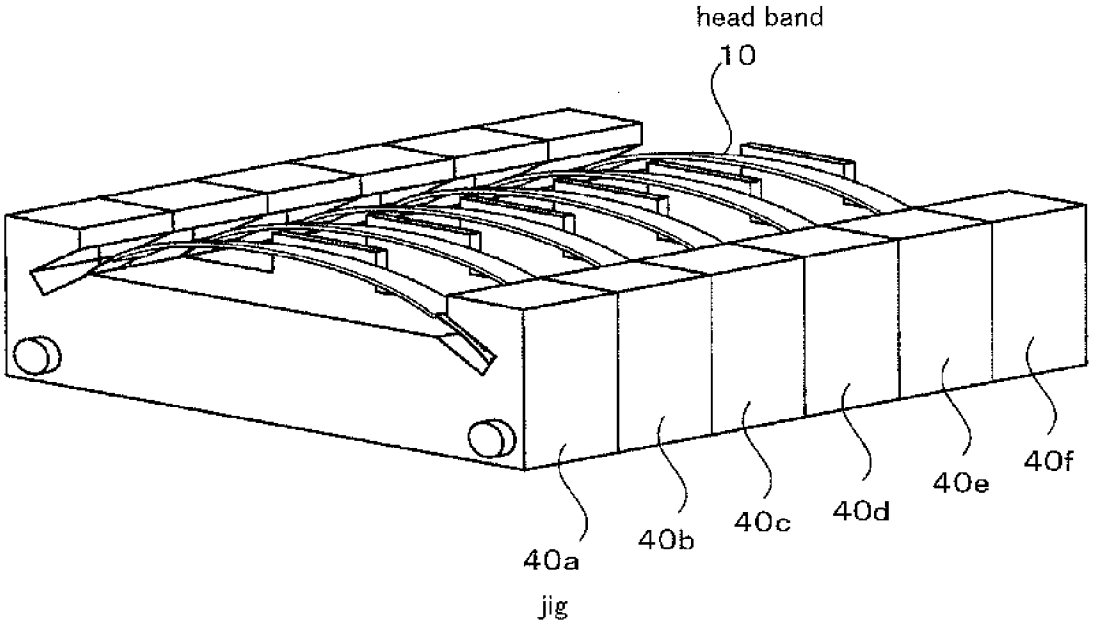
FIG. 8 is a perspective diagram of the connected six jigs 40*a* to 40*f*.

FIG. 8 shows a perspective view of the six jigs 40*a* to 40*f* connected in this manner. As shown in FIG. 8, each of the six jigs 40*a* to 40*f* is connected to its adjacent jig, and it is fixed with the head band 10 being stretched.

Then, in the state where the six jigs 40*a* to 40*f* are connected as shown in FIG. 8, the image is printed with respect to the respective head bands 10 with the ink jet printing apparatus (not shown). Note that the ink jet printing apparatus prints the image by performing ink jet printing using UV (Ultra Violet) ink (ultraviolet setting type ink) only in an area where the printing is to be performed on the head bands 10.

Figure 9:
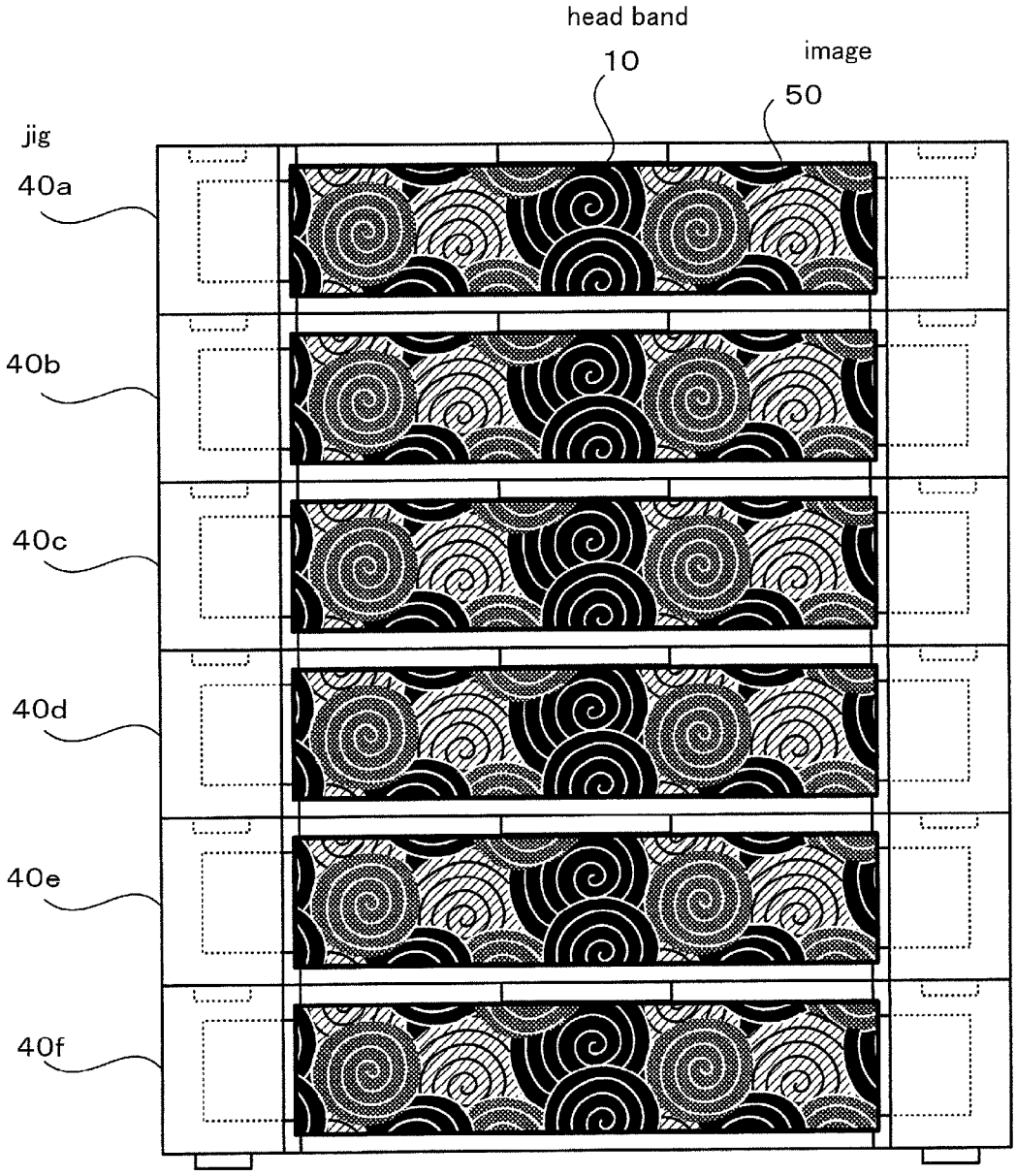
FIG. 9 is a diagram showing the head bands 10 on which images are respectively printed.

FIG. 9 shows the state where the images 50 are printed on the head bands 10 in this manner. Thereafter, UV light is emitted on the head bands 10 so as to set the UV ink, and the printing processing ends.

Figure 10:
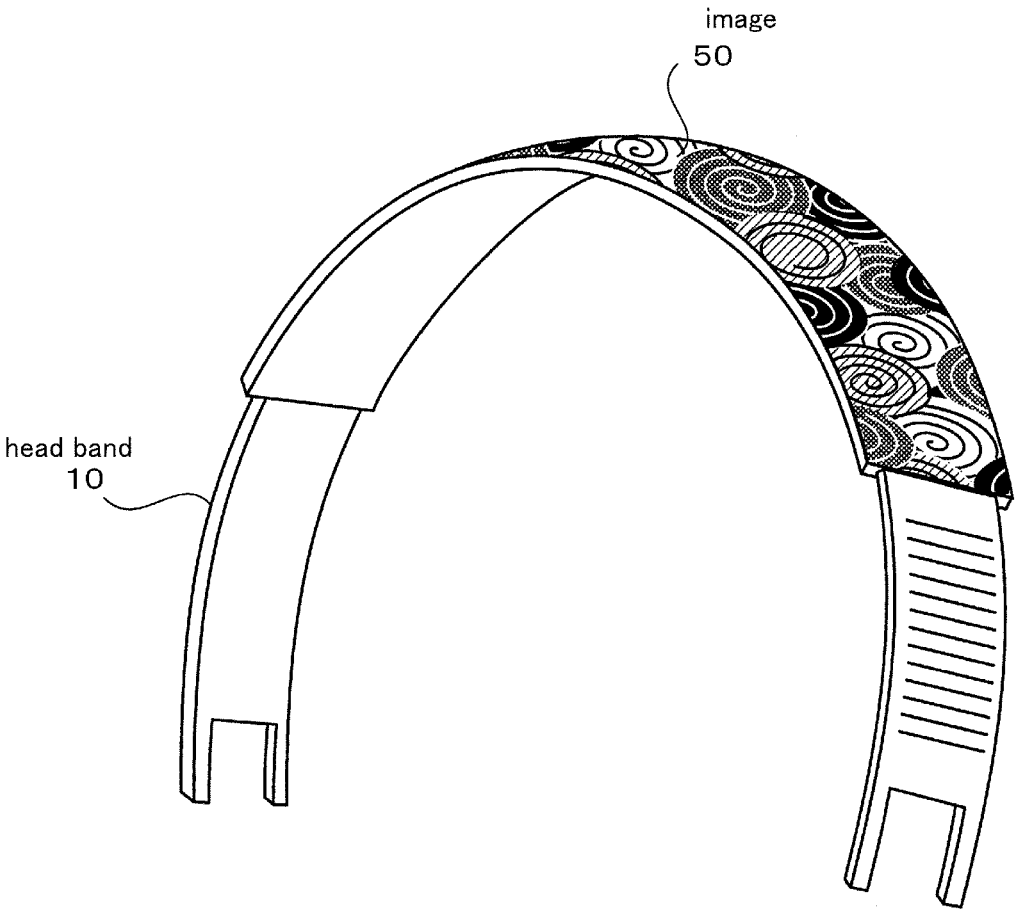
FIG. 10 is a diagram showing the head band 10 where the image is printed by color printing on the bent part.

Thereafter, the head bands 10 are removed from the respective jigs 40*a* to 40*f*, and the head bands 10 on which the images 50 are printed as shown in FIG. 10 are obtained.

Figure 11:
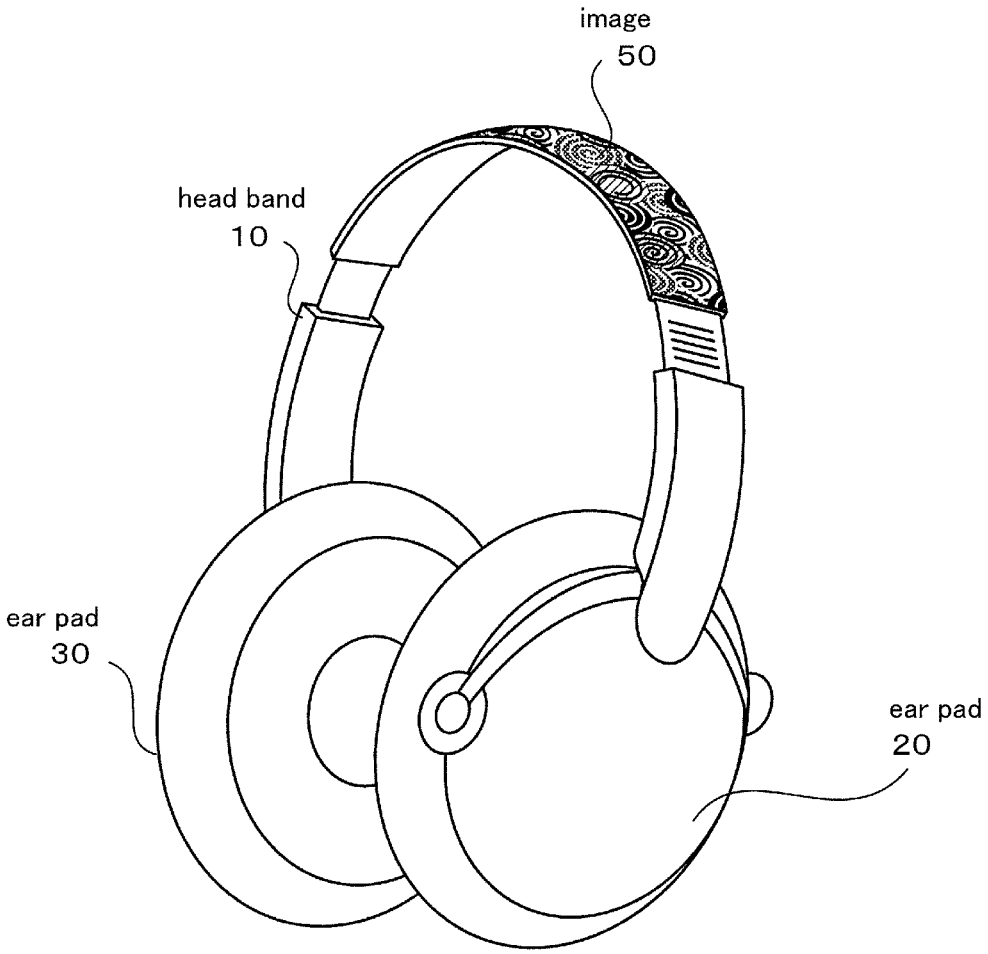
FIG. 11 is a diagram showing the headphone where the image is printed by color printing on the bent head band 10.

Then, finally, the ear pads 20 and 30 are attached to the head band 10 on which the image 50 is printed, and a headphone with the image 50 printed on the bent head band 10 is completed as shown in FIG. 11.

In the printing method according to the present embodiment, since a bent part is removed from a product and printing processing is performed on the bent part which is stretched with a jig, it is possible to perform printing with respect to a position where printing is initially impossible even using an ink jet printer.

Further, it is possible to perform color printing when printing is performed with the ink jet printer using UV ink of plural colors. According to the printing method according to the present embodiment, it is possible to perform high quality color printing even with respect to a bent part made of resin or the like.

[Modification]

In the above-described embodiment, the image 50 is printed with respect to the bent part fixed with the jig 40 by color printing using UV ink by ink jet printing. The present invention is not limited to this embodiment. The present invention is also applicable to a case where printing is performed with respect to the bent part using UV ink by other printing methods than the ink jet printing. Further, the present invention is applicable to even a case where color printing is performed by other printing methods without UV ink. It is possible to perform color printing with respect to the bent part which is stretched and fixed with the jig 40. Further, when the material of the bent part as a printing object medium has heat resistance higher than thermal transfer process temperature in thermal transfer printing such as sublimation type printing, it is possible to perform color printing with respect to the resin bent part stretched and fixed with the jig 40 by thermal transfer printing.

Further, in the above-described embodiment, the product having the bent part is a headphone and the bent part is a head band. The present invention is not limited to this example, and is also applicable to other products having a resin bent part. For example, the present invention is also applicable to any product as long as the product has a stretchable bent part such as a head band like Alice band.

Further, the bent part is not necessarily made of resin. The present invention is also applicable to a bent part made of metal or the like as long as it is stretchable and is fixed, in a stretched state, to a jig.

REFERENCE SIGNS LIST

10 . . . head band,
20 . . . ear pad,
30 . . . ear pad,
40, 40*a* to 40*f* . . . jig
41, 42 . . . boss,
43, 44 . . . boss hole,
50 . . . image

The invention claimed is:

1. A printing method with respect to a headphone having a head band which is a single-piece, non-woven stretchable resin bent part, comprising:

a step of stretching the head band by loading the head band into a jig;

a step of fixing the stretched head band, in a stretched state, with the jig such that the stretched head band is flattened to a degree required for printing an image on the stretched head band;

a step of performing color printing on the flattened head band fixed with the jig; and a step of returning the stretched printed head band to an unstretched state by removing the stretched printed head band from the jig.

2. The printing method according to claim 1, wherein at the step of performing color printing with respect to the head band fixed with the jig, color printing using UV ink is performed with respect to the head band fixed with the jig.

3. The printing method according to claim 2, wherein at the step of performing color printing using UV ink with respect to the head band fixed with the jig, color printing using UV ink by ink jet printing is performed with respect to the head band fixed with the jig.

4. The printing method according to claim 1, wherein said printing comprises ink jet printing or transfer printing.

5. The printing method according to claim 1, wherein the headphone comprises left and right ear pads detachably affixed to opposite ends of the head band.

6. The printing method according to claim 5, wherein the head band has a spring force that causes the headphones to press against the ears and keep the headphones in place.

7. The printing method according to claim 1, which comprises attaching left and right ear pads to opposite ends of the printed head band to complete the headphone.

8. The printing method according to claim 1, wherein the stretched head band returns to its full original shape only by its own internal elasticity once removed from the jig.

9. The printing method according to claim 1, wherein the head band resists deformation.

* * * * *